United States Patent [19]

Zimmern et al.

[11] Patent Number: 4,968,231

[45] Date of Patent: Nov. 6, 1990

[54] OIL-FREE ROTARY COMPRESSOR WITH INJECTED WATER AND DISSOLVED BORATE

[75] Inventors: Bernard Zimmern, 6 New St., East Norwalk, Conn.06855, Ernest Kallmann, Neuilly-s/Seine, France

[73] Assignee: Bernard Zimmern, East Norwalk, Conn.

[21] Appl. No.: 318,060

[22] Filed: Feb. 17, 1989

[30] Foreign Application Priority Data

Feb. 23, 1988 [FR] France ..... 88 02115

[51] Int. Cl.[5] ..... F04C 29/02; F01P 11/06; C10M 173/00

[52] U.S. Cl. ..... 418/1; 418/85; 418/97; 418/DIG. 1; 252/387

[58] Field of Search ..... 418/1, 85, 97–100, 418/DIG. 1; 184/6.16; 252/387

[56] References Cited

U.S. PATENT DOCUMENTS

| | | | |
|---|---|---|---|
| 3,306,235 | 2/1967 | Lewis et al. | 252/387 |
| 3,889,879 | 6/1975 | Wellman et al. | 123/41.29 |
| 4,237,090 | 12/1980 | DeMonbrun et al. | 252/387 |
| 4,409,113 | 10/1983 | Bertell | 252/42 |
| 4,534,873 | 8/1985 | Clark | 252/32.7 E |

FOREIGN PATENT DOCUMENTS

| | | | |
|---|---|---|---|
| 1331998 | 6/1963 | France . | |
| 1586832 | 1/1970 | France . | |
| 2171653 | 9/1973 | France . | |
| 219033 | 2/1985 | German Democratic Rep. . | |
| 233394 | 2/1986 | German Democratic Rep. | 418/97 |
| 736215 | 9/1955 | United Kingdom | 252/387 |
| 846390 | 8/1960 | United Kingdom . | |

*Primary Examiner*—John J. Vrablik

*Attorney, Agent, or Firm*—Robert F. Ziems

[57] ABSTRACT

In order to produce oil-free compressed air with a rotary compressor while avoiding the costs involved by a liquid-free compressor, a rotary compressor, especially a single screw rotary compressor is injected with water in which borate, preferably potassium borate is dissolved. This prevents corrosion at no additional cost while improving the bacterial purity of the air produced.

10 Claims, 1 Drawing Sheet

OIL-FREE ROTARY COMPRESSOR WITH INJECTED WATER AND DISSOLVED BORATE

Figure 1:
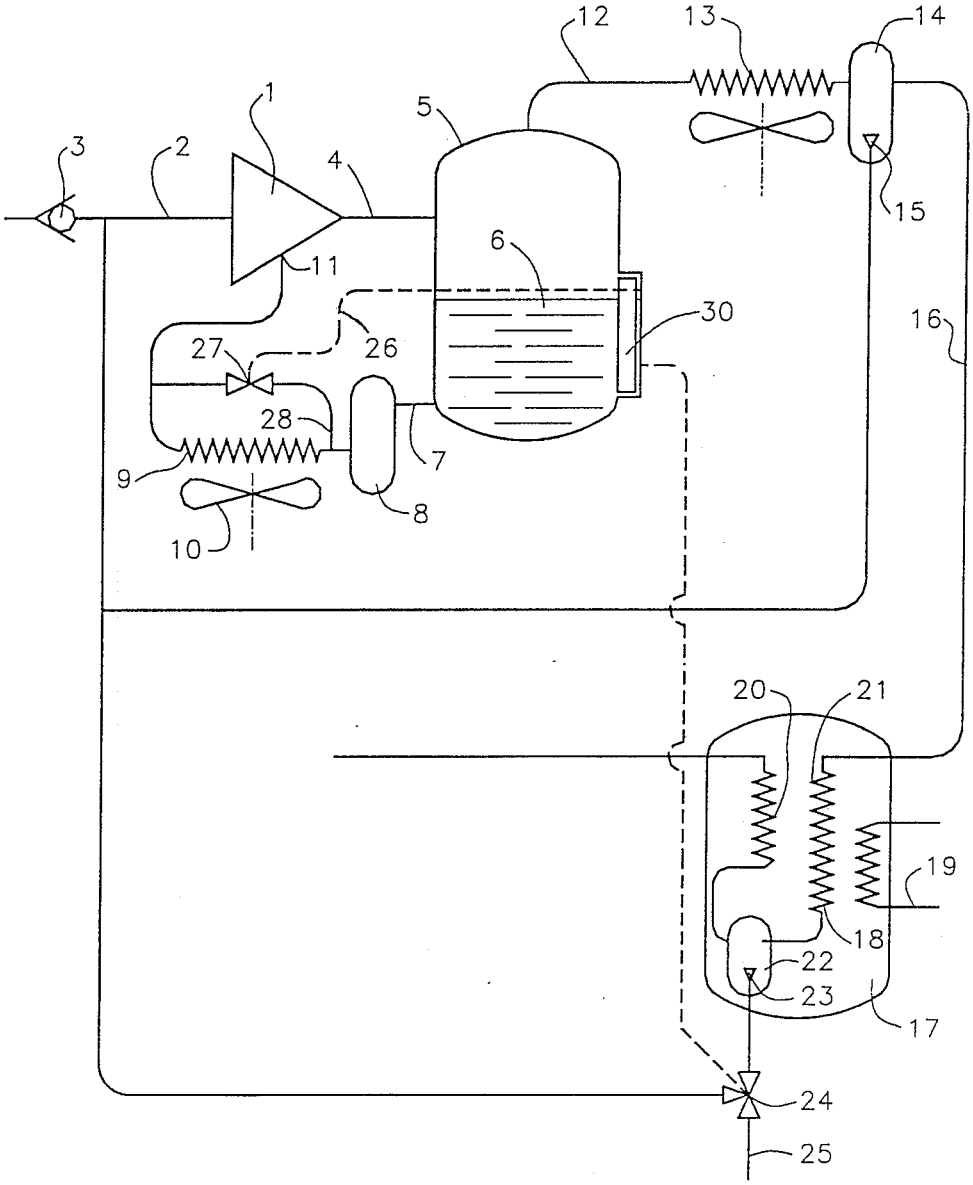

The invention is directed to an air-compression assembly using an "oil-free" rotary compressor and to an air compressing method relating thereto. "Oil-free" means that no oil is used for sealing the compression chamber(s) in the compressor.

It is well known to realize oil-free rotating compressors, by using twin screw compressors the two rotors of which are synchronized by means of external gears, so as to avoid that they come into mutual contact.

Nevertheless, in order to obtain a sufficient efficiency, as nothing ensures the leak-tightness between the rotors, it is necessary to rotate them at high speed, around 10,000 rpm, which makes such compressors very noisy; the capacity (flow-rate) is correspondingly increased. Thus, for producing air at a discharge pressure of 7 to 8 bar, it is difficult to use compressors of that type, if the needed flow-rate corresponds to less than 50 or 100 HP. These compressors are also very expensive because the synchronizing gears must be immersed in oil and separated from the rotors by mechanical seals.

A solution to overcome this difficulty and to obtain smaller compressors but still with a good efficiency is to inject water into the compression chambers; the compressors are then silenced, and the leaks become acceptable, thus permitting much lower rotating speeds.

Certain twin screw compressors and even single screw compressors — such as described for instance in French Pat. Nos. 1 331 998 or 1 586 832 — have been sold and are sold with such a water injection replacing the oil injection. The advantage of the water injection is that it adds no supplementary product, such as oil, to the air, because water already exists, in the form of moisture, in the air taken in; therefore, the compressed air may be designated as oil free air.

Nevertheless such compressors remain very expensive, because they must be protected against corrosion; this implies that, first, the material used for the casting, the screws, etc..., be stainless — such as bronze — or protected against corrosion — for instance by nickel-plating. Secondly, the bearings must be protected from the water and grease or oil-lubricated if they are standard friction-less bearings such as ball or roller bearings.

Such compressors are finally not cheaper than standard oil-free compressors such as reciprocating compressors with PTFE piston-rings i.e. they remain at least 50 to 80 % more expensive than oil-injected compressors.

This additional cost has considerably limited the use of such oil-free compressors, the share of which in the air-compressor market does not exceed 10 to 15 percent. If the cost would be the same, oil free compressors would cover some 60 percent of this market, as this is already the market-share of systems associating a compressor and a dryer, the user of such systems obviously looking for clean air.

OBJECT OF THE INVENTION

The object of the invention is to provide an oil-free air compression assembly using a rotary compressor, and a method of compressing air, which overcome the above problems.

SUMMARY OF THE INVENTION

According to the invention, there is provided an air-compression assembly comprising a rotary compressor, the discharge of said compressor being connected to a tank partly filled with water, the lower part of said tank being connected via a conduit to at least one injection hole provided on the rotary compressor, said conduit being provided with means for cooling the water, and wherein the water contains dissolved borate at a concentration sufficient to avoid the corrosion of ferrous metals.

Still according to the invention, there is provided a method of comprising air in a rotary compressor, comprising the steps of:

injecting into the compressor water containing dissolved borate;

separating said water containing dissolved borate from compressed air discharged by the compressor;

using said water containing dissolved borate having been separated from said compressed air for continuing injection of water containing dissolved borate into the compressor.

It has indeed been found that by simply adding borate and especially sodium or potassium borate to the water, the same compressor used to compress air with oil injection can also be used to compress air with water injection; in other words, the oil can be replaced by water containing borate and it is neither necessary to change the material of the cast-parts such as the housing or of the screw, usually cast iron, by stainless material, nor to change the material of the piping system-tubes, pressure tank, etc... to protect them against corrosion. Thus, the cost of oil-free compressors finally becomes close to that of oil-injected compressors, and this is expected to allow a much wider use of oil-free air.

It has moreover been found that, thanks to the very low vapour pressure of the borate crystal, the quantities of borate which are lost due to leaving the compressor with the compressed air are negligible, and that it is thus possible to run a compressor for a very long time without having to add crystal. This is a major advantage over known liquid corrosion-inhibitors, such as soluble oils or products called 5-95; these liquids have a non-negligible vapour pressure; during tests it has been impossible to run for more than 100 hours without having to add inhibitor; this makes them improper, first because of the cost of the liquid that must be frequently added, and secondly because of the technical problems involved by the need of refilling in due time to avoid any corrosion.

It has also been found that the known liquid inhibitors make the water foam and that it is difficult to prevent that foaming; one must then use expensive centrifugal systems or coalescing elements; moreover, upon stopping of the compressor, the tank pressure drops to atmospheric pressure; the air dissolved in the water bubbles, and with such liquid inhibitors this bubbling instantaneously entails a very important formation of foam that either leaves via the compressed air piping or implies the use of large and huge tanks. No foaming occurs with borate solution which behaves, in this respect, like water.

It has been also found that whatever the size of the microscopic droplets containing borate that leave the water tank, they go to the dryer and are finally found in the condensed water normally disposed of as sewage the concentration of borate in this condensed water is very low, around a fraction of a percent; once diluted in the sewage water, this concentration does not increase significantly the natural concentration of borate in water; thus, disposing of that quantity of borate as sewage has no damageable consequence on the environment.

It has been also found that, contrary to the other inhibitor crystals such as chromates, nitrites, phosphates or silicates, the borates are not unstable in the presence of oxygen and are not harmful to the health.

On the contrary it has been found that, as aqueous solutions containing borate are slightly basic with a pH around 9, they inhibit the growth of bacteria or destroy them. One of the problems having heretofore prevented the use of water-flooded compressors is precisely that, due to the warm temperature of the water, there is a quick growth of bacteria; this compels to constantly renew the water by draining old water and supplying fresh one. This is very costly and introduces new problems such as scale formation. With borate solution, analysis show 0 bacteria after thousands hours of running.

Furthermore, the bacteria sucked with the air by the compressor are, in substantial proportion, killed by passage in the compressor; in one test, it has been found that air containing, when taken-in, 60 bacteria per cubic meter contained less than 6 after compression with injection of water-borate solution.

This invention will be better understood by reading the description hereafter and the attached drawing, given as a non-limitating example and wherein the figure shows the structure of an air-compression assembly or package according to the invention.

The figure shows a compressor 1 driven by a motor and taking in air through an intake conduit 2 and a check valve 3 Which closes when the compressor is not in use.

The compressor is of the rotary type and preferably a single screw compressor, as described in French Pat. Nos. 1 331 998 or 1 586 832.

The compressor 1 discharges into a conduit 4, connected to a tank 5, which contains a liquid shown in 6. When the tank 5 is pressurized by the compressor, the liquid 6 exits via a conduit 7 and passes through a filter 8 and a heat exchanger 9, in which said liquid is cooled, in this example, by air moved by a fan 10 (but it could be cooled by other means such as water). Said liquid is then injected into the compressor by at least one orifice 11, is recompressed with the gas and separated by gravity in the tank 5. The orifice 11 is provided through a housing of the compressor and registers with the or each compression chamber when said chamber is at a pressure below the discharge pressure, thereby to allow injection due to the discharge pressure prevailing in tank 5.

The compressed air leaves the tank 5 by a conduit 12, connected to an after-cooler 13, followed by a reservoir 14, where the vapour condensate can be separated from the air flow and can be returned to the compressor intake by conventional means such as a float valve 15. The cooled gas then passes through a conduit 16 and reaches a dryer 17, comprised, for example, of a coil 18, cooled by a refrigerant circulating in a coil 19. Part of the heat of the gas is transferred from a coil 20 to a first section 21 of the coil 18. A separator 22, with a float valve 23 returns all condensates to a three-way valve 24, controlled by a liquid-level detector 30 provided in the tank 5. If the level in tank 5 is below a first or lower threshold, the three-way valve is set to return the condensates to the compressor intake; otherwise, they are sent via a conduit 25 to the drain, as sewage. If the level in the tank exceeds a second or upper threshold, a sensor, via line 26, controls opening of a valve 27 whereby the heat-exchanger 9 is at least in part by-passed by a conduit 28. Such a device has already been described in French Pat. No. 2 171 653.

Except for the following, this system is generally conventional and has been used for years with oil, and even with water under several alternative forms: with a pump, instead of the air pressure, for moving the water; with or without a coalescing element in the tank to free the compressed air from the droplets remaining in the gas; etc. All these alternatives can be used without changing the nature of the invention.

The main differences between the system as described and a conventional system in which the liquid shown in 6 would be oil are essentially:

there is provided the by-pass 28, to maintain the concentration of borate in the water, according to French Pat. No. 2 171 653;

the heat-exchanger 9 is larger to limit the water temperature and to reduce the production of steam when the water is injected into the compressor, because such steam reduces the useful volume taken in and thus the efficiency. Borate being basic, and hence, attacking aluminium, a copper or steel heat-exchanger should be used, but is has been checked that the cost of steel, cooper or aluminium exchangers is practically the same;

the coalescing element, usually set in the tank 5 to eliminate the "oil mist" may be either eliminated (the surface tension of water being higher, the droplets are larger and can thus be gathered more easily) or replaced by a simple arrangement of baffles;

the frictionless-type bearings are replaced by plain bearings particularly carbon bearings able to operate in water and the cost of which, at least for single-screw compressors which produce very low thrust loads, is comparable to conventional frictionless oil-lubricated bearings.

Otherwise both systems are identical, as they may both use the same ferrous materials for the cast-parts, the bearings, the conduits, the tank, none of which requires a specific protection.

As borate is an inexpensive crystal and as it is generally used with a percentage below 10 percent, and though the water must be deionized (failing which the borate precipitates the calcium carbonate), the liquid remains less costly than the oil refill required in oil injected compressors.

As a whole, the cost of both systems is the same within a few percents, With the additional major advantage of most of the components being standardized, in view of the reduction of inventories or in view of launching the production of oil-free machines.

It is clear that this applies to packages used above the temperature of 0° C., otherwise a special protection should be provided, such as an electric heater set at the lower part of the system and energized when the temperature falls below a preset value, so as to prevent the formation of ice in the circuit.

It has been found that sodium borate, commonly designated as borax, at a concentration of 4 to 5 percent, was sufficient to prevent any corrosion. Nevertheless, the invention prefers using potassium borate, and specifically dipotassium tetrahydrate tetraborate $K_2O$-2 $B_2O_3$-4 $H_2O$, because of its great solubility in water, so that there may exist some losses without running any risk of corrosion whatsoever. With sodium borate, the solubility of which is less, such high concentration is possible when the water is warm, but crystals appear at cooling down; such crystals, carried away by the liquid, might damage the compressor at start-up. Thus, sodium borate has the disadvantage that the maximum concentration permitted to avoid crystallisation is also close to the minimum concentration needed to prevent corrosion. This leaves only a narrow available range of concentrations.

Also, when stopping the compressor, if the intake would not be closed by a means 3, for example a check-valve or a solenoid or pneumatic valve, the compressor could dry and the borate crystals would make the screw-rotor adhere to the compressor-housing, thereby rendering the starting-up difficult and creating mechanical problems.

It is possible to eliminate the water left in the compressor, for instance by letting the air in the tank 5 leave through the compressor 1 after stopping. But the proposed method consisting in maintaining the intake closed, so that the liquid in the compressor, whatever the quantity thereof, cannot dry, is much simpler.

During the tests it has been found that with potassium borate at concentrations between 2 and 10 percent, no trace of rust appeared in the compressor or in the pipings; the water did not foam more than without borate, a behaviour quite different from the one observed with liquid-type corrosion inhibitors; the borate carried-over by the compressed air in the dryer, for an air compressor of 20 HP discharging at 7 bar gauge, were found very small, generating a condensate of borate in the water at a concentration below 0.5 percent.

None of these results could be obtained with other inhibitors; all liquid inhibitors tested, or which can be thought of, have a vapour pressure and a carry-over by the steam in the compressed air such that the water gets deprived of its inhibitor within a few hours; it becomes necessary to proceed with costly refillings and to add a system to monitor minimum concentration.

Other solid inhibitors, such as sodium chromate, are health-hazardous, or are unstable with time in the presence of oxygen.

So, borate, and more specifically potassium borate appears to be the only solution to the problem.

Moreover it provides the unexpected advantage of killing bacteria, preventing their development in the tank, and delivering compressed air that is hygienically cleaner than when taken in.

We claim:

1. An air-compression assembly comprising a rotary compressor, the discharge of said compressor being connected to a liquid/air separator tank partly filled with water, a lower part of said tank being connected via a conduit to at least one injection hole of said rotary compressor, said conduit being provided with means for cooling the water, and wherein the water contains dissolved borate at a concentration sufficient to avoid the corrosion of ferrous metals.

2. An air-compression assembly according to claim 1 wherein the borate is potassium borate.

3. An air-compression assembly according to claim 1, Wherein closing means are located on an intake line of the compressor, in order to close the intake when the compressor is at rest.

4. An air-compression assembly comprising a rotary compressor, the discharge of said compressor being connected to a tank partly filled with water, a lower part of said tank being connected via a conduit to at least one injection hole of said rotary compressor, said conduit being provided with means for cooling the water, and wherein the water contains dissolved dipotassium tetrahydrate tetraborate at a concentration sufficient to avoid the corrosion of ferrous metals.

5. An air-compression assembly according to claim 4, wherein closing means are located on an intake line of the compressor, in order to close the intake when the compressor is at rest.

6. A method of compressing air in a rotary compressor, comprising the steps of:

injecting into the compressor water containing dissolved borate at a concentration sufficient to avoid corrosion of ferrous metals;

separating said water containing dissolved borate from compressed air discharged by the compressor;

using said water containing borate having been separated from said compressed air for continuing injection of water containing dissolved borate into the compressor.

7. A method according to claim 6, wherein water containing dissolved potassium borate is used as said water containing borate.

8. A method according to claim 6, comprising the steps of closing the intake of said compressor when said compressor is at rest.

9. A method of compressing air in a rotary compressor, comprising the steps of:

injecting into the compressor water containing dissolved dipotassium tetrahydrate tetraborate at a concentration sufficient to avoid corrosion of ferrous metals;

separating said water containing dissolved dipotassium tetrahydrate tetraborate from compressed air discharged by the compressore;

using said water containing dipotassium tetrahydrate tetraborate having been separated from said compressed air for continuing injection of water containing dissolved dipotassium tetrahydrate tetraborate into the compressor.

10. A method according to claim 9, comprising the step of closing the intake of said compressor when said compressor is at rest.

* * * * *